US005322023A

United States Patent [19]

Hammond

[11] Patent Number: 5,322,023

[45] Date of Patent: Jun. 21, 1994

[54] TABLE TRAY ADAPTED FOR INSTALLATION AROUND AN UMBRELLA POLE

[76] Inventor: Timothy R. Hammond, 1505 Village Walk Dr., Zionsville, Ind. 46077

[21] Appl. No.: 48,468

[22] Filed: Apr. 16, 1993

[51] Int. Cl.[5] ..... A47B 35/00

[52] U.S. Cl. ..... 108/50; 135/16

[58] Field of Search ..... 100/50, 94, 93, 90; 135/16, 96

[56] References Cited

U.S. PATENT DOCUMENTS

| | | | |
|---|---|---|---|
| 19,773 | 3/1858 | Hagey . | |
| D. 291,635 | 9/1987 | Dickman . | |
| 2,386,739 | 10/1995 | Epworth | 108/50 |
| 2,458,371 | 1/1949 | Grice . | |
| 2,509,719 | 3/1952 | McKinney | 108/94 X |
| 2,680,660 | 6/1954 | Stephens | 108/94 |
| 2,870,946 | 1/1959 | Herndon . | |
| 3,577,583 | 5/1971 | Amann . | |
| 4,003,320 | 1/1977 | Owens et al. | 108/90 X |
| 4,334,482 | 6/1902 | Bolduc | 108/94 X |
| 4,401,036 | 8/1983 | Russo et al. | 108/50 X |
| 4,653,716 | 3/1987 | Sakaguchi . | |
| 4,708,256 | 11/1987 | Intardonato . | |
| 5,161,561 | 11/1992 | Jamieson . | |

*Primary Examiner*—Jose V. Chen

*Attorney, Agent, or Firm*—Woodard, Emhardt, Naughton, Moriarty & McNett

[57] ABSTRACT

A service tray for use on a table and received about a projection, such as an umbrella pole, is disclosed. The tray comprises a tray member defining a slot and a closure member for mounting to the tray member and closing the slot to define a central aperture in which an umbrella pole or the like is receivable. The connection of the closure member to the tray member is readily released, allowing the slot of the tray member to be opened to permit insertion around or removal from the umbrella pole or the like. The tray includes a plurality of compartments for receiving items such as vegetables and dips, condiments, etc. Rollers are positioned on the underside of the tray member to facilitate rotation of the tray on a supporting surface.

6 Claims, 2 Drawing Sheets

TABLE TRAY ADAPTED FOR INSTALLATION AROUND AN UMBRELLA POLE

BACKGROUND OF THE INVENTION

1. Field of the Invention

The present invention relates to trays, and particularly to an annular food tray adapted for ready installation and use around an umbrella pole.

2. Description of the Prior Art

In certain designs of outdoor patio furniture, a table is provided which includes an umbrella having a pole extending through a hole in the center of the table. Although the umbrella serves a desirable purpose in providing shade for persons using the table, the pole presents an obstacle for placement of food, condiments or other articles at the center of the table for access by all persons seated around the table.

To overcome this problem, the prior art has proposed trays which include a central opening through which the umbrella pole is received. A portable tray for attachment to a beach umbrella is disclosed in U.S. Pat. No. 291,635, issued to Dickman on Sep. 1, 1987. The umbrella tray comprises a solid disc with a central aperture and a pair of collars with set screws for locking onto the beach umbrella. A two-piece table tray defining a central opening for reception of an umbrella pole is described in U.S. Pat. No. 4,708,256, issued to Intardonato on Nov. 24, 1987. This tray includes two half-circle shapes which are separable from one another, and which include connecting means on each side of the umbrella pole for securing of the halves together. This patent also suggests use of a bearing assembly under the base of the tray to facilitate rotation of the tray upon the table.

Service trays of the foregoing types have not received significant commercial success. Perhaps one reason for this is the fact that it is awkward for these units to be installed upon a table around an umbrella pole. For unitary devices, it is necessary to remove the umbrella pole and then place the large and relatively heavy pole and umbrella assembly through a tight fitting aperture in the service tray. Other devices have provided separable tray elements which can be connected around the pole while it is in place, but these devices are not readily transported in disassembled form, nor easily aligned and connected about the pole. There has remained a desire for a service tray that is easily disassembled and assembled, thus facilitating both transportation of the tray and installation of the tray around an umbrella pole. These and other features and advantages are provided by the present invention.

SUMMARY OF THE INVENTION

A service tray is provided which is adapted for use upon a table having a center projection such as an umbrella pole. The tray includes a tray member defining a radial slot having a width sized to receive a pole therein, and a closure member mountable within the slot to fully enclose the pole. Means are provided for securing together the tray and closure members. The combined tray and closure members are configured when assembled to provide a central aperture within which an umbrella pole or like device is receivable. In view of the manner of connection of the members, the tray is readily transported without requiring full disassembly. Also, installation is easily accomplished because the tray member can be slid to receive the pole within the slot and the closure member added to complete the service tray.

It is an object of the present invention to provide a service tray which is adapted for use upon a table having a center projection such as an umbrella pole. It is a further object of the present invention to provide a service tray of the foregoing type which is readily assembled and disassembled.

Another object of the present invention is to provide a service tray which freely rotates upon a table around an umbrella pole or like projection.

Further objects and advantages of the present invention will become apparent from the description of the preferred embodiment which follows.

DESCRIPTION OF THE PREFERRED EMBODIMENT

Figure 1:
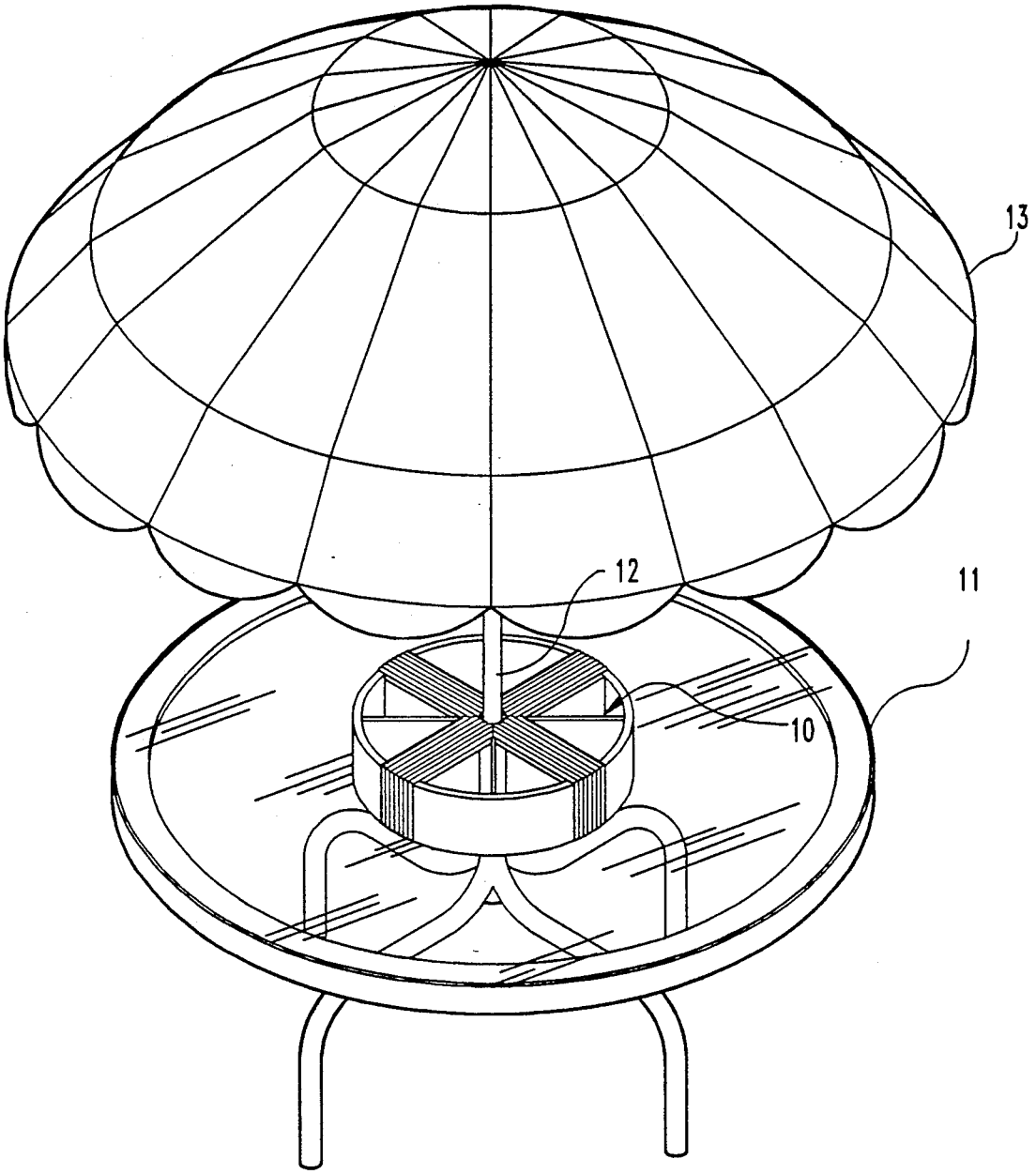
FIG. 1 is a perspective view of a patio table and umbrella assembly with which is shown a service tray according to the present invention.
Figure 2:
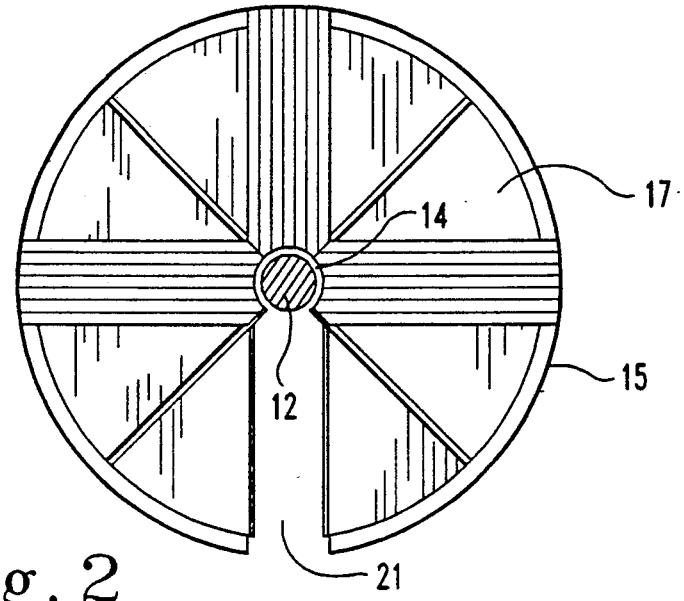
FIG. 2 is a top, plan view showing the tray member of the present invention.

For the purposes of promoting an understanding of the Principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

The present invention provides a serving tray readily adapted for use upon a table having a center projection, for example an umbrella pole. The tray is readily disengaged from around the umbrella pole, without requiring removal of the pole from the table. The tray is also readily repositioned about the umbrella pole. Once in position, the tray provides one or more compartments within which various items may be contained. For example, the tray may be used to contain food items, including vegetables, crackers, dips, condiments, etc. In addition, the tray may include rollers which permit the tray to be rotated, thereby increasing the convenience of service of items from the tray.

Referring in particular to the drawings, there is shown a service tray 10 constructed in accordance with the present invention. For example, tray 10 is shown in FIG. 1 in position upon a table 11 and received about a pole 12 supporting an umbrella 13. Tray 10 includes a central aperture 14 within which the pole 12 is received. It will be appreciated that the aperture 14 may be sized and shaped in any manner desirable to permit the tray to be received about a projection of various types which may extend upwardly from a table or other supporting surface. Therefore, the tray 10 is not limited to use with an umbrella pole, but may be equally suited for use about a variety of objects, and the description herein with respect to an umbrella pole is for purposes of illustration only.

Figure 3:
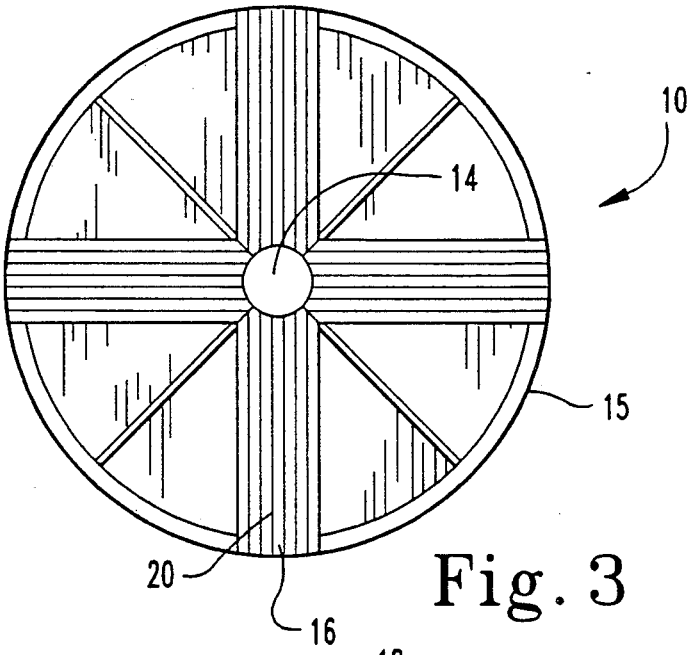
FIG. 3 is a top, plan view showing the service tray with the closure member positioned on the tray member.

The tray 10 is comprised of a tray member 15 and a closure member 16. The tray member preferably defines one or more compartments, such as 17, for reception of items therein. In an alternate embodiment, the tray member 15 may receive a plurality of separate compartmental units. The tray member and closure member fit together to form preferably an annular-shaped tray 10 shown particularly in FIG. 3. Other overall shapes may also be provided, such as rectangular, hexagonal, or irregularly shaped units. A round configuration is particularly preferred for trays which are intended to be rotated to facilitate service therefrom.

Figure 4:
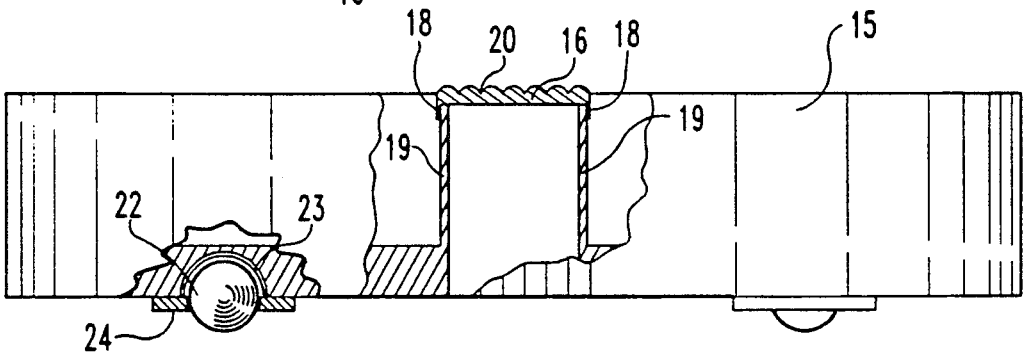
FIG. 4 is a front, elevational view showing a tray constructed in accordance with the present invention, and particularly showing a preferred means for connecting the closure member to the tray member, and for providing rolling movement of the tray upon a surface.

The closure member is joined to the tray member in any of a variety of ways. For example, as shown in FIG. 4 the closure member may have edges 18 which overlap upstanding walls 19 of the tray member. Spanning wall 20 then closes the slot 21 to complete the serving tray. In the alternative, the closure member may be secured to the tray member by various means such as a hinged connection, snap fit or the like.

The service tray is readily installed and removed from an umbrella pole or other like projection. With the closure member removed, the tray member may be slid relative to the pole such that the pole is received within the slot 21. The closure member is then secured to the tray member, which thereby defines the central aperture 14 within which the object, such as the umbrella pole, is received. By providing a slotted tray member and closure member separable therefrom, it is possible to readily open and close the serving tray with suitable alignment therebetween. This also provides a stabilized tray when installed, and also when being transported to and from the table.

Further enhancements of the service tray may be provided. As shown for example in FIG. 4, a plurality of rollers may be provided on the underside of the tray member to support the tray on a surface and to facilitate its rotation. Such rolling means may assume a variety of conventional forms. For example, the rollers may simply comprise ball bearings 22 received in recesses 23 in the tray members, and held therein by retainers 24 secured to the tray members. Preferably, at least three such rollers are provided to produce a stable, and easily rotated service tray.

The tray 10 and its component parts may be formed from a variety of materials. For example, various hard plastics are well suited to making up the tray components, which then can be conveniently molded in the forms shown. Other materials, including aluminum or other metals, may also be used as desired.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A tray adapted for use upon a table having a center projection such as an umbrella pole, comprising:

a tray member adapted for receiving items, said tray member defining a radial slot having a width sized to receive a pole or the like;

a closure member mountable to said tray member to close the slot and to thereby define with said tray member a central aperture within which a pole or the like is receivable; and means for releasably connecting together said tray member and said closure member, said tray member and said closure member having a first, unassembled position with the closure member removed, enabling insertion of an object such as an umbrella pole into the slot defined by said tray member, said tray member and said closure member having a second position with the closure member connected with said tray member and defining therewith a central aperture within which a center projection is receivable.

2. The tray of claim 1 and which further includes roller means associated with said tray member for permitting rolling of said tray member upon a surface.

3. The tray of claim 2 in which said tray member includes an underside defining several pockets sized for receiving ball bearings therein, said roller means comprising ball bearings received within each of the several pockets and adapted for rolling upon a surface.

4. The tray of claim 1 in which said tray member includes a plurality of separate compartments for receiving items therein.

5. The tray of claim 4 and which further includes roller means associated with said tray member for permitting rolling of said tray member upon a surface.

6. The tray of claim 5 in which said tray member includes an underside defining several pockets sized for receiving ball bearings therein, said roller means comprising ball bearings received within each of the several pockets and adapted for rolling upon a surface.

* * * * *